US007104540B2

(12) United States Patent
Ruiz

(10) Patent No.: US 7,104,540 B2
(45) Date of Patent: Sep. 12, 2006

(54) SHEET HANDLING METHOD AND APPARATUS

(75) Inventor: Israel Cruz Ruiz, Guadalajara (MX)

(73) Assignee: Hewlett-Packard Development Company, L.P., Houston, TX (US)

( * ) Notice: Subject to any disclaimer, the term of this patent is extended or adjusted under 35 U.S.C. 154(b) by 268 days.

(21) Appl. No.: 10/228,713

(22) Filed: Aug. 27, 2002

(65) Prior Publication Data

US 2004/0041337 A1 Mar. 4, 2004

(51) Int. Cl.
*B65H 9/16* (2006.01)

(52) U.S. Cl. ..... 271/250; 271/248

(58) Field of Classification Search ..... 271/248, 271/250, 251, 252

See application file for complete search history.

(56) References Cited

U.S. PATENT DOCUMENTS

| | | | | |
|---|---|---|---|---|
| 3,220,569 A | | 11/1965 | Willits et al. | |
| 3,981,496 A | * | 9/1976 | Jensen et al. | 271/314 |
| 4,248,413 A | | 2/1981 | Fox | |
| 4,681,312 A | * | 7/1987 | Harvey | 271/207 |
| 5,060,926 A | * | 10/1991 | Murai et al. | 271/111 |

FOREIGN PATENT DOCUMENTS

| | | | |
|---|---|---|---|
| GB | 2141695 A | * | 1/1985 |
| JP | 03094275 | | 4/1991 |

* cited by examiner

*Primary Examiner*—Eileen D. Lillis
*Assistant Examiner*—Kaitlin Joerger

(57) ABSTRACT

An apparatus for handling a sheet of material comprises: a paper accumulator that receives at least one sheet of paper, and at least one first roller that applies a force against a first edge of the sheet in a first direction parallel to the first edge, so as to move the sheet within the paper accumulator at least until a second edge of the sheet reaches a registration position.

20 Claims, 6 Drawing Sheets

SHEET HANDLING METHOD AND APPARATUS

FIELD OF THE INVENTION

The present invention relates to conveyor mechanisms generally, and more specifically, to systems for registering paper.

BACKGROUND OF THE INVENTION

Collating and stapling are common features of higher end photocopiers. Prior to stapling, these systems move all of the sheets to be stapled until they are completely aligned with each other in an accumulator. This is typically accomplished by moving each sheet until it contacts and is stopped by a fixed registration surface.

Accumulators commonly feature rollers that touch the "just-printed" zone of the paper. This may result in either removal or smearing of the ink that has just been applied to the paper, particularly in systems that use a wet ink, such as inkjet printers.

Other paper registration systems include wings that require several parts and motors. These mechanisms are noisy and expensive.

An improved sheet registration system is desired.

SUMMARY OF THE INVENTION

A method for handling a sheet of material comprises the steps of: contacting a first edge of a sheet of material, and applying a friction force against the first edge of the sheet in a first direction parallel to the first edge, so as to move the sheet at least until a second edge of the sheet reaches a registration position.

A method for handling a sheet of paper comprises the steps of: moving a sheet of paper until a first edge of the sheet of paper contacts one or more first rollers that do not contact a face of the sheet of paper, and rotating the first rollers, so as to move the sheet in a first direction parallel to the first edge of the sheet at least until a second edge of the sheet contacts a registration surface.

An apparatus for handling a sheet of material comprises: a paper accumulator that receives at least one sheet of paper, and at least one first roller that applies a force against a first edge of the sheet in a first direction parallel to the first edge, so as to move the sheet within the paper accumulator at least until a second edge of the sheet reaches a registration position.

Another exemplary apparatus for handling a sheet of material comprises: a first roller for applying a force against a first edge of the sheet in a first direction parallel to the first edge, so as to move the sheet within the paper accumulator at least until a second edge of the sheet reaches a registration position; and a second roller for moving the sheet of paper to cause the edge of the sheet to contact the force applying means.

DETAILED DESCRIPTION

Figure 1:
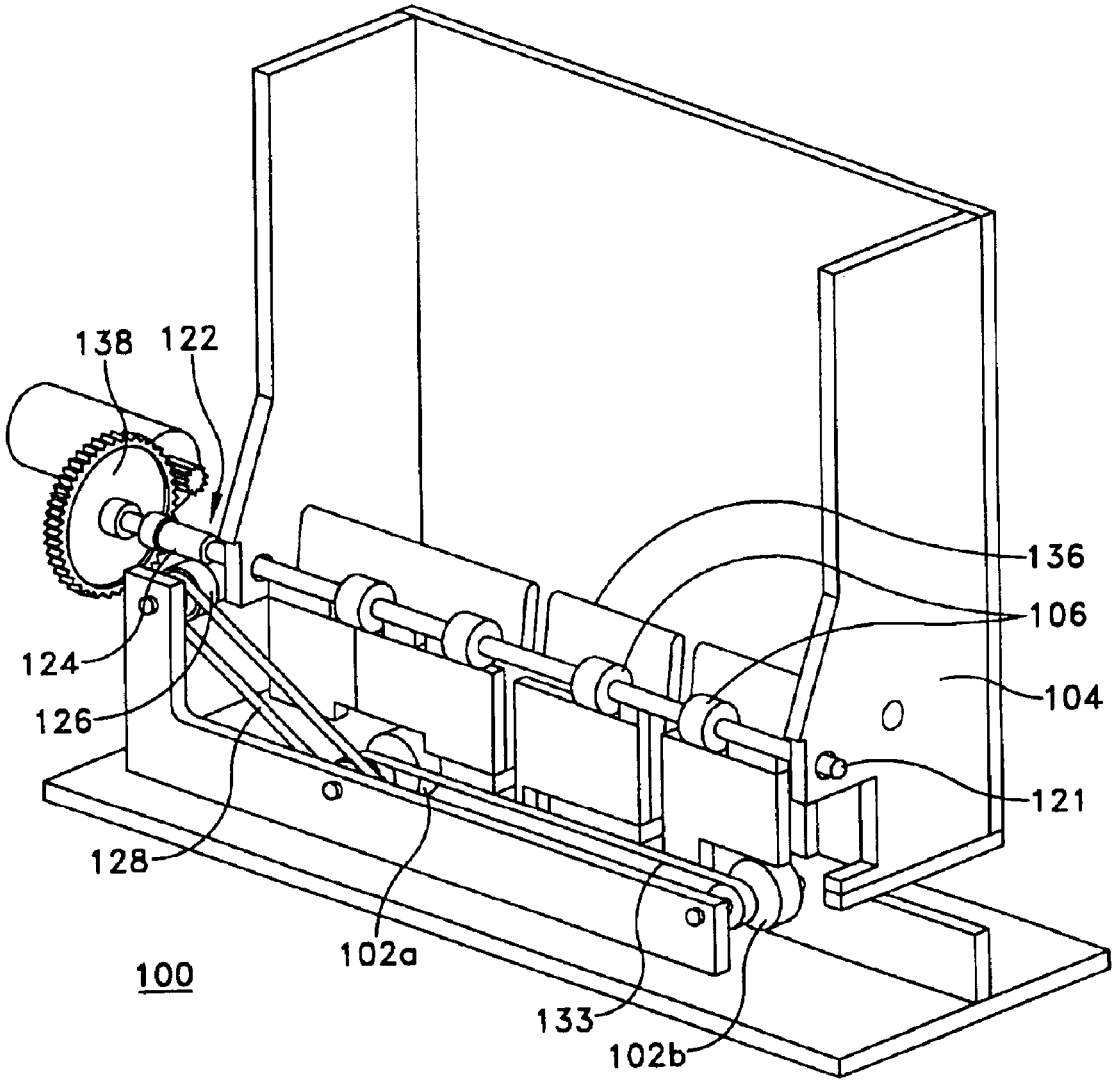
FIG. 1 is an isometric view of a first accumulator according to one exemplary embodiment of the present invention.

FIGS. 1–6 show a first exemplary registration system 100 for handling a sheet 99 of material. The system 100 receives a plurality of sheets 99 of paper from a device such as a photocopier or multifunction peripheral device, and aligns the sheets prior to stapling or binding.

The system 100 includes means for applying a force 98 (shown in FIG. 4) against a first edge 99*a* of the sheet 99. The force 98 is applied in a first direction parallel to the first edge, so as to move the sheet 99 within a paper accumulator bin 103 at least until a second edge 99*b* of the sheet reaches a registration position. The force applying means may be, for example, a first conveyor or one or more rollers 102*a*, 102*b*. Alternative force applying means may include a belt, a brush, or a finger, for example.

The system 100 further includes means for moving the sheet of paper to the force applying means. The sheet moving means may include, for example, a second conveyor or one or more rollers 106 or belts.

The exemplary apparatus for handling a sheet of material comprises a paper accumulator bin 103 that receives at least one sheet 99 of paper, and at least one first roller 102*a* that applies a force 98 against a first (bottom) edge 99*a* of the sheet in a first direction parallel to the first edge. The assembly 100 of FIG. 1 includes two or more first rollers 102*a*, 102*b* that contact the first edge 99*a* of the sheet 99 of paper without contacting a face 99*c* of the sheet 99 of paper. The rollers 102*a*, 102*b* move the sheet 99 within the paper accumulator 103 at least until a second edge 99*b* of the sheet reaches a registration position at which the second edge contacts a registration wall (e.g., the side wall) 104 of the accumulator bin 103.

Although the exemplary registration position is a position in which the sheet 99 contacts the side wall 104 of the accumulator bin 103, other registration positions may be used. For example, in some embodiments a stop or other protuberance projecting from one of the walls of the bin 103 may also be included, so that the registration position is the position at which the paper contacts the stop or protuberance. In other embodiments, the registration position may be a position at which an edge of the paper crosses the path of a sensor (not shown), such as an optical sensor. The sensor could produce a signal usable to stop rotating the rollers 102*a*, 102*b* when the sheet reaches the sensor, particularly in embodiments having a separate motor operating the registration rollers 102*a*, 102*b* such as those described below with reference to FIG. 7.

Figure 5:
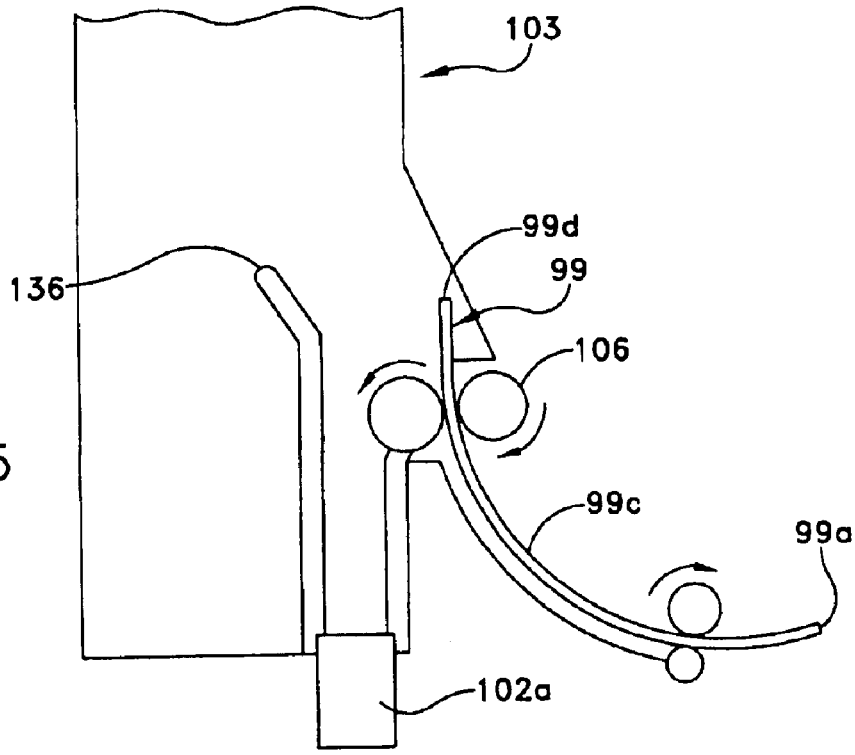
FIG. 5 shows the feed roller for the registration system of FIG. 1, with a sheet of paper being fed into the accumulator bin.
Figure 6:
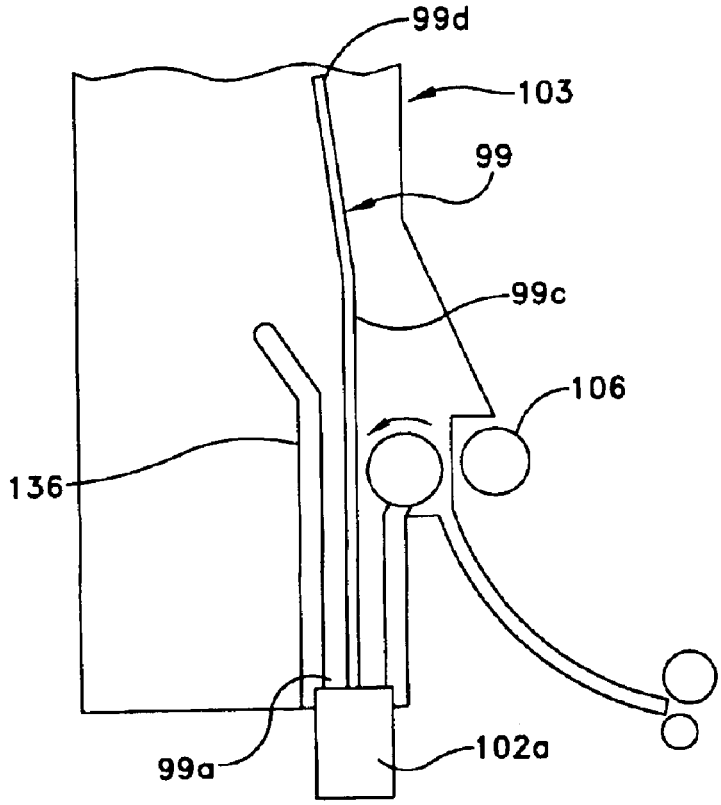
FIG. 6 shows the accumulator bin of FIG. 5, wherein a sheet of paper is dropped onto the registration rollers.

In the exemplary embodiment, the sheets of paper 99 are registered vertically in the vertical accumulator 103 using gravity, as best seen in FIGS. 5 and 6. The bottom edge 99*a* of the paper 99 touches both registration rollers 102*a*, 102*b*. The registration rollers 102*a*, 102*b* rotate (clockwise in FIG. 1) and move the sheets 99 of paper towards the registration wall 104. The friction between the rollers 102*a*, 102*b* and the edge of the sheet of paper 99 is high enough to drive the paper towards the registration wall 104, and low enough to allow the rollers to slip past the paper after the paper reaches the wall, while the rollers 102*a*, 102*b* are still rotating. This eliminates the need for a complex clutch mechanism or switching mechanism.

Figure 2:
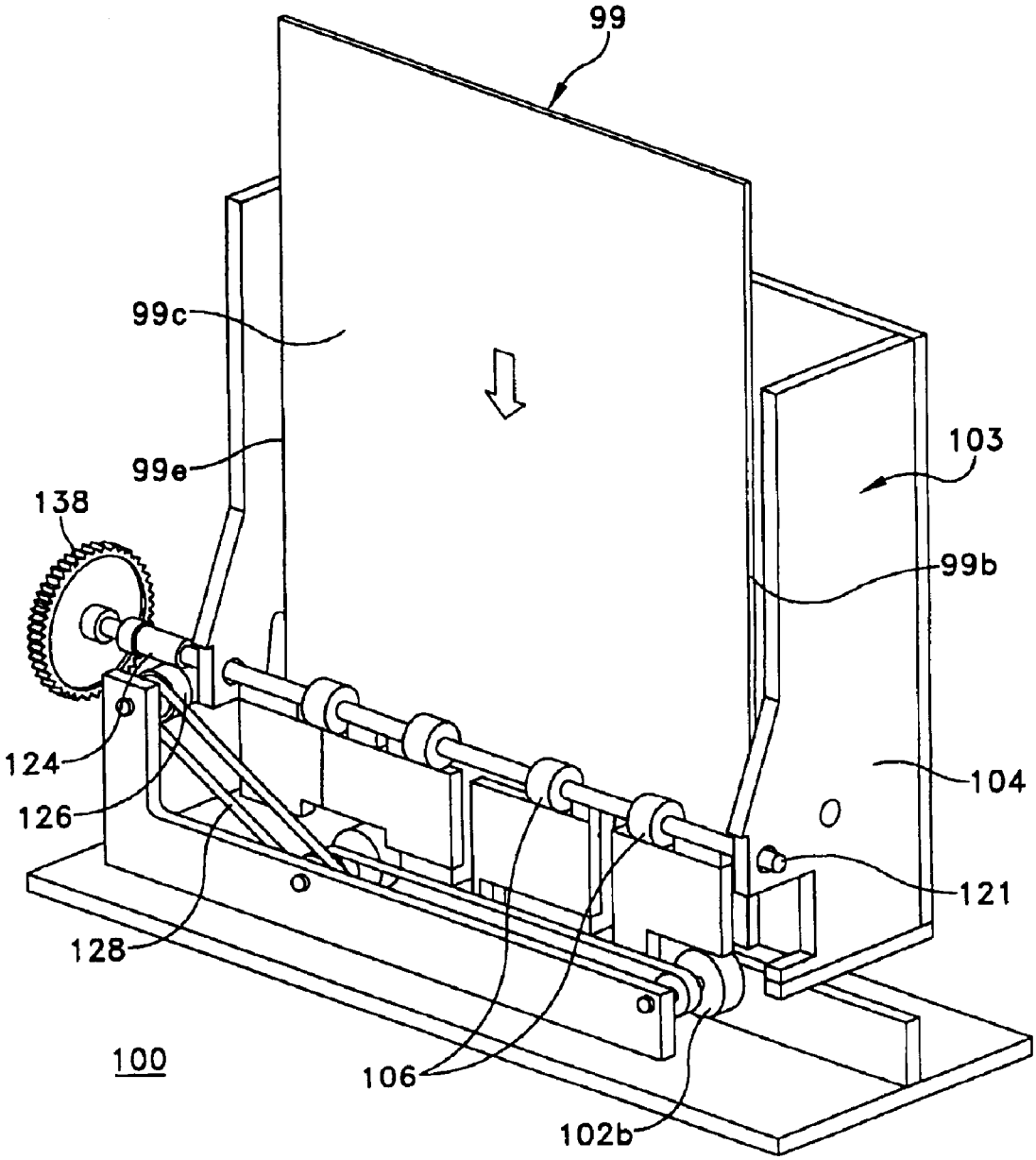
FIG. 2 shows a paper being fed into the accumulator of FIG. 1.
Figure 3:
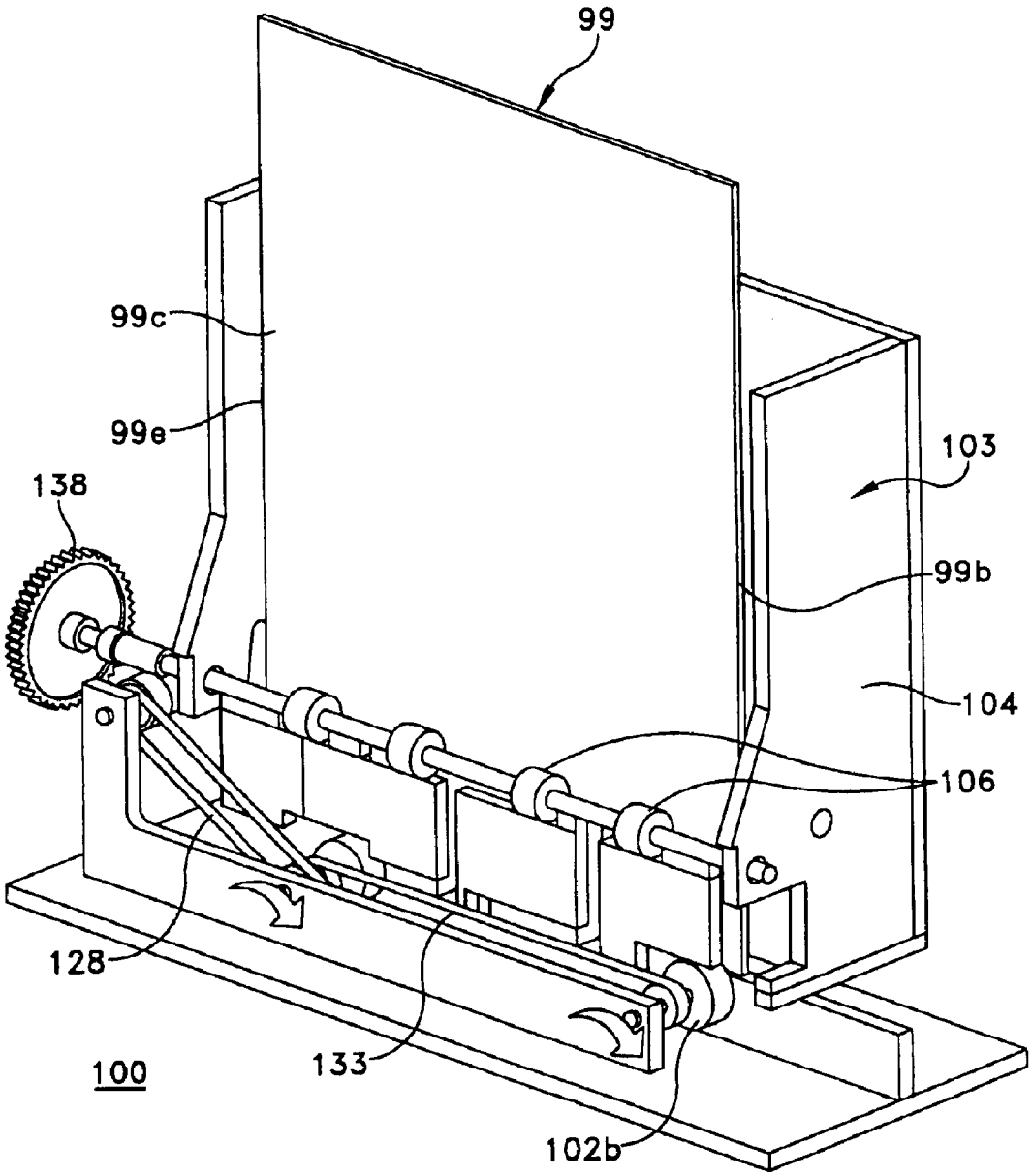
FIG. 3 shows the paper of FIG. 2 being registered against a registration wall of the accumulator.

In the exemplary system 100 the sheet advancing means include at least one second (feed) roller 106 or belt that contacts the face 99*c* of the sheet 99 of paper. FIGS. 1 and 2 show a plurality of second rollers 106. The second rollers 106 cause the paper 99 to advance in a second direction perpendicular to the first direction until the first edge 99*a* of the sheet 99 contacts the first (registration) rollers 102*a*, 102*b*. As best seen in FIG. 5, the second rollers 106 feed the sheet 99 into the bin 103, so that the leading edge 99*d* of the paper moves upwards as the sheet moves into the bin 103. When the trailing edge 99*a* of the sheet 99 of paper moves past the second rollers 106, the paper drops vertically, so that the trailing edge 99*a* lands on the rollers 102*a*, 102*b*. In some alternative embodiments (not shown), the leading edge 99*d* of the sheet 99 of paper moves downwards as the sheet moves into the bin 103, in which case the leading edge of the paper would land on the rollers 102*a*, 102*b*. A short vertical wail 136 (FIGS. 1, 5 and 6) is positioned close to the rollers 102*a*, 102*b*, to assure that the edge 99*a* always touches the rollers 102*a*, 102*b*. Wall 136 also helps to maintain the stack 99 vertical and "unbuckled".

The exemplary apparatus 100 further comprises at least one motor 120 and a transmission 122 coupling the force applying means (e.g., first rollers 102*a*, 102*b*) and the sheet moving means (e.g., second rollers 106) to the motor. Thus, a single motor 120 can advance the sheet 99 of paper along its path between the printer (or copier, facsimile machine, scanner, or multifunction peripheral device) and the registration bin 103, and also provide the transverse force 98 parallel to the edge 99*a* of the sheet. The motor 120 may be a DC motor or a stepper motor. Although the use of a single motor 120 simplifies control of the system 100, it is also contemplated that the first rollers 102*a*, 102*b* and the second rollers 106 could be driven by two separate motors, as described further below with reference to FIG. 7.

Figure 4:
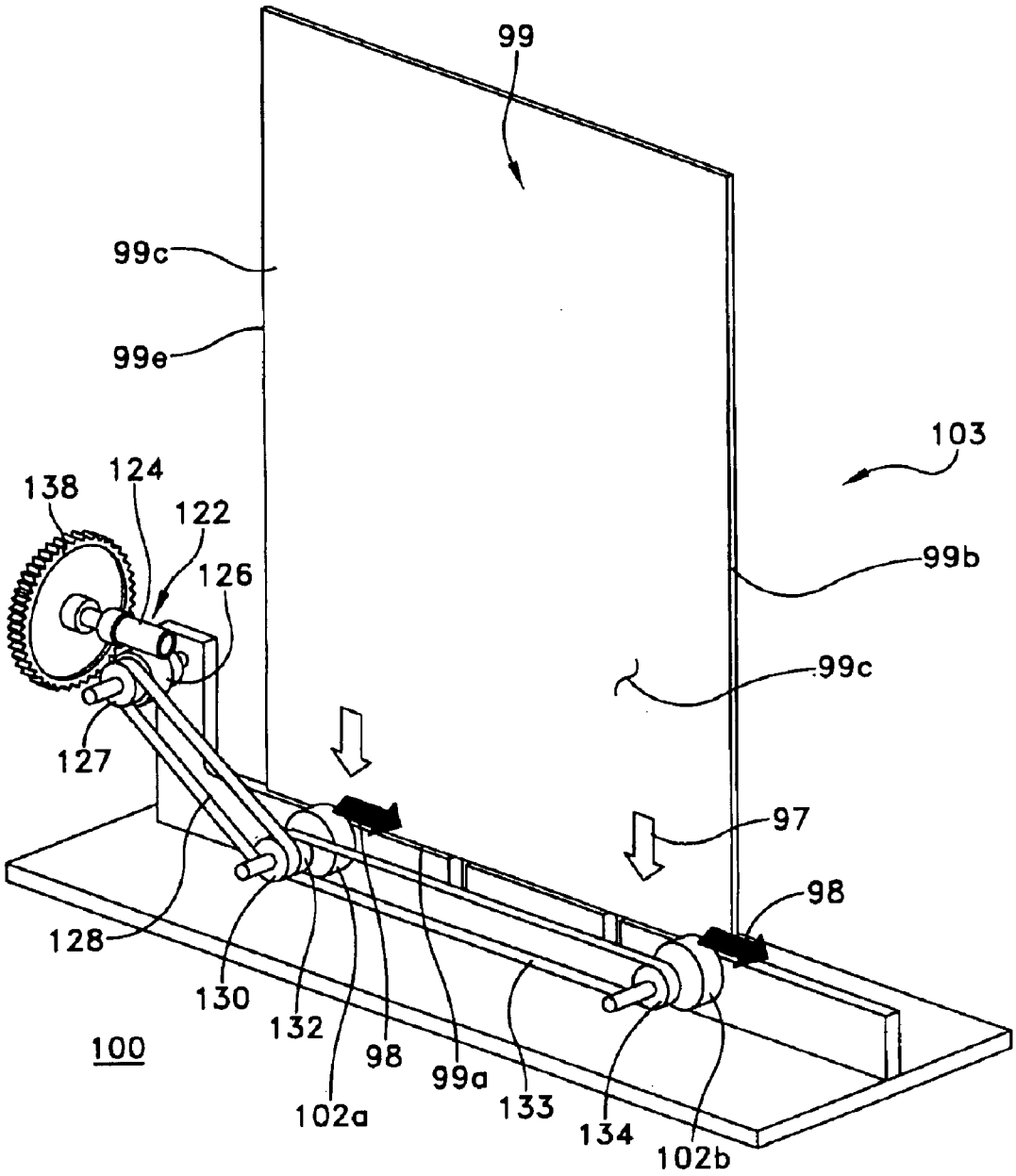
FIG. 4 shows the accumulator of FIG. 2 with a cover plate removed to reveal the registration mechanism.

The exemplary transmission 122 is best seen in FIG. 4, and includes a worm gear 124, a crown gear 126 and a belt 128. The exemplary worm gear 124 rotates about the axis of a rod 121 on which the rollers 106 are mounted. Worm gear 124, rod 121 and rollers 106 are fixed to rotate together with the same angular velocity. Crown gear 126 is rotated by the motion of the worm gear 124, which is rotated by the shaft of motor 120. There may be one or more gears 138 connecting the shaft of the motor 120 to the rod 121; only one gear 138 is shown in the figures. Crown gear 126 is also attached to a pulley 127, which may be a timing belt pulley. A timing belt 128 connects timing belt pulley 127 to a second timing belt pulley 130 that is connected to one of the rollers 102*a*. Timing belt pulley 130 and the corresponding roller 102*a* are fixed to rotate together with the same angular velocity. Timing belt 128 provides a simple means to transfer torque from the crown gear 126 to a roller 102*a* at a different height. Also, by selecting the ratio of the size of pulleys 127 and 130, the ratio between the rotation speed of rollers 106 and the rotation speed of rollers 102*a*, 102*b* is controlled.

Although the exemplary belt 128 is a timing belt and pulley 127 is a timing belt pulley, in other embodiments, a flat belt or a V-belt with a corresponding pulley may be used to drive roller 102*a*. Alternatively, a gear and chain drive may be substituted. In some embodiments, the transmission may be made of interconnecting gears without any intervening belt or chain.

In the exemplary force applying means, the two rollers 102*a* and 102*b* are connected by a belt 133. A pulley 132 is fixedly attached to rotate with roller 102*a* and a pulley 134 is fixedly attached to rotate with roller 102*b*. In other embodiments, the two rollers 102*a*, 102*b* may be connected by a chain and gears, a timing belt and timing belt pulley, a V-belt and pulley, or equivalent torque transfer mechanism. Generally, it is not necessary for the rotation speed of the rollers 102*a* and 102*b* to be controlled with a high accuracy, so that a variety of torque transfer devices may be used.

The rollers 102*a*, 102*b* are preferably formed of a strong, hard material that resists abrasion from the paper. (The possibility of abrasion is greatest when the paper is slipping relative to the rollers 102*a* and 102*b*, i.e., when the edge 99*b* of sheet 99 stops moving at the registration wall 104 of bin 103, and the rollers 102*a*, 102*b* continue to rotate.) For example, steel rollers 102*a*, 102*b* may be used. The rollers may be provided with a rough surface (e.g., a ridged, grooved or knurled surface), for moving the sheet 99 of paper without slippage until the paper reaches the registration position. The friction force 98 is sufficient to move the sheet 99 towards a registration surface 104, but is small enough so as not to warp the sheet when the sheet contacts the registration surface and stops moving. Because the friction force is the product of the "normal force" (i.e., the weight of sheet 99) and the coefficient of friction, the surface of rollers 102*a*, 102*b* is selected to provide a coefficient of friction that is effective across a range of paper weights.

Although the example shows the bottom edge 99*a* of the sheet 99 of paper engaging the rollers 102*a* and 102*b*, other embodiments are possible. For example; in some embodiments, the belt 133 may be used as a conveyor, and the edge 99*a* of the paper can be seated directly on the belt 133 (in which case the rollers 102*a*, 102*b* may be omitted). Belt 133 may have a rough surface, for increasing the friction between the belt and the edge 99*a* of the paper. In some embodiments, belt 133 may have a plurality of finger-like members (not shown) attached to the outer surface of the belt to enhance the application of the force 98 parallel to the paper's edge 99*a*. In other embodiments, belt 133 may have brushes (not shown) attached thereto, to apply the force 98.

The exemplary embodiments feature a bin 103 that orients the sheets 99 vertically during registration. It is also contemplated that the techniques described above may be used with registration bins that are oriented horizontally, or at any angle. This adds another dimension to the method. Although the exemplary vertical bin 103 can rely on gravity and the weight of each sheet 99 to drop the sheet onto the registration rollers 102*a*, 102*b* and to provide the normal force 97 needed to generate the friction force 98, a horizontal system (or system oriented at any other substantially non-vertical angle) would affirmatively push the sheet 99 against the registration rollers 102*a*, 102*b* to generate the normal force. This could be achieved by rollers or belts on or beneath the face 99*c* of sheet 99, or fingers pulling the edge 99*d*.

Although the exemplary embodiment features registration rollers 102*a*, 102*b* at the bottom edge 99*a* of the sheet, the registration rollers could also be applied at the top edge 99*c* of the sheet 99. This also adds a dimension to the method. Although the exemplary rollers 102*a*, 102*b* can be in a fixed position for paper of any length, to place the registration rollers at the top edge 99*c* of sheet 99, it is contemplated that the registration rollers would be repositionable to accommodate sheets 99 of various lengths.

Figure 7:
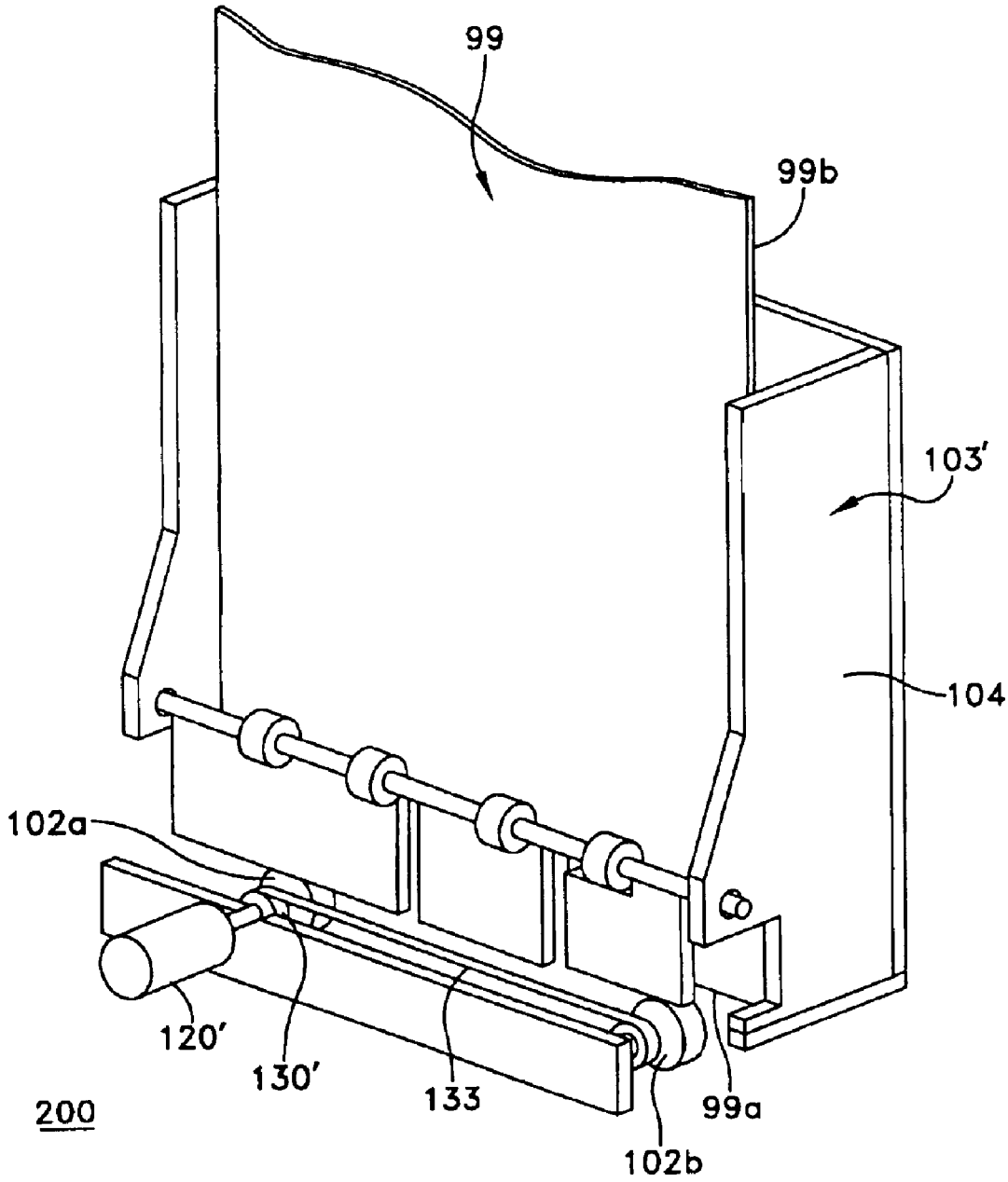
FIG. 7 is an isometric view of an accumulator according to another exemplary embodiment of the present invention.

Although the exemplary embodiment of FIGS. 1–6 use the same motor to actuate the feed rollers 106 and the registration rollers 102*a*, 102*b*, other embodiments may use a separate motor to actuate the registration rollers 102*a*, 102*b*. FIG. 7 shows another exemplary apparatus 200 for registering a sheet of material 99. A paper accumulator 103' receives at least one sheet 99 of paper. At least one first roller 102*a*, 102*b* applies a force against a first edge 99*a* of the sheet in a first direction parallel to the first edge, so as to move the sheet within the paper accumulator 103' at least until a second edge 99*b* of the sheet reaches a registration position. As shown in FIG. 7, the roller 102*a* may be directly driven by the shaft of the motor 120'. Roller 102*b* may be connected to roller 102*a* by a belt 133, as shown in FIG. 7.

Alternatively, in another embodiment (not shown) roller 102*b* may roll freely without any connection to roller 102*a*, so that the friction force is only applied against the edge 99*a* of the sheet by roller 102*a*. In other embodiments, (not shown), the paper may rest on the belt 133 or a chain driven by the motor 120'. Other alternative embodiments may have a separate motor 120' actuating the edge rollers 102*a*, 102*b* but include a transmission (having, belts, chains and/or gears, for example) connecting the motor to one of the rollers.

In alternative embodiments having a separate motor for actuating the rollers 102*a*, 102*b*, the wall 104 of the bin 103 may have a control (not shown), such as, for example, a button or bar, to actuate a switch (not shown) when the sheet 99 of paper contacts the control. The switch could turn off the motor when the paper contacts the control.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A method for handling a sheet of material, comprising the steps of:

contacting a first edge of a sheet of material;

applying a friction force against the first edge of the sheet in a first direction parallel to the first edge, so as to move the sheet at least until a second edge of the sheet reaches a registration position; and before contacting and applying the friction force against the first edge of the sheet, advancing the sheet in a second direction orthogonal to the first direction, including moving the sheet in the section direction, allowing the sheet to drop in a third direction opposite the second direction, and orienting the sheet so that the weight of the sheet applies a force orthogonal to the friction force, wherein the first direction is horizontal and the second direction is vertical.

2. The method of claim 1, wherein contacting the first edge of the sheet with one or more first rollers.

3. The method of claim 2, wherein applying the friction force against the first edge of the sheet includes rotating the one or more first rollers to apply the friction force.

4. The method of claim 2, wherein the one or more first rollers have a rough or ridged surface.

5. The method of claim 1, where the friction force is sufficient to move the sheet towards a registration surface, but is small enough so as not to warp the sheet when the sheet contacts the registration surface and stops moving.

6. A method for handling a sheet of material, comprising:

contacting a first edge of a sheet of material with one or more first rollers;

applying a friction force against the first edge of the sheet in a first direction parallel to the first edge using the one or more first rollers, so as to move the sheet at least until a second edge of the sheet reaches a registration position;

driving the one or more first rollers using a motor;

turning off the motor when the sheet reaches the registration position; and before contacting and applying the friction force against the first edge of the sheet, advancing the sheet in a second direction orthogonal to the first direction.

7. The method of claim 6, wherein advancing the sheet in the second direction includes:

rotating at least one second roller to advance the sheet in the second direction, the second roller oriented orthogonally to the first rollers.

8. A method for handling a sheet of paper, comprising the steps of:

(a) moving a sheet of paper with a motor until a first edge of the sheet of paper contacts one or more first rollers that do not contact a face of the sheet of paper;

(b) rotating the first rollers with the same motor, so as to move the sheet in a first direction parallel to the first edge of the sheet at least until a second edge of the sheet contacts a registration surface, the first direction being orthogonal to a second direction in which the sheet is moved in step (a), wherein the second direction is vertical and the first direction is horizontal, and wherein moving the sheet in step (a) includes first moving the sheet in the second direction and then moving the sheet in a third direction opposite the second direction.

9. The method of claim 8, wherein step (a) includes advancing the sheet with a second roller that contacts the face of the sheet of paper.

10. The method of claim 9, wherein the one or more first rollers and the second roller are coupled with a worm gear, a crown and a belt.

11. Apparatus for handling a sheet of material, comprising:

a paper accumulator that receives at least one sheet of paper;

at least one first roller that applies a force against a first edge of the sheet in a first direction parallel to the first edge, so as to move the sheet within the paper accumulator at least until a second edge of the sheet reaches a registration position;

at least one second roller that contacts the face of the sheet of paper, the second roller causing the paper to advance in a second direction perpendicular to the first direction; and a motor and a transmission that couples the first and second rollers to the motor, wherein before the at least one first roller applies the force against the first edge of the sheet, the paper accumulator and the at least one second roller move the sheet in the second direction, allow the sheet to drop in a third direction opposite the second direction, and orient the sheet so that the weight of the sheet applies a force orthogonal to the force of the at least one first roller, and wherein the first direction is horizontal and the second direction is vertical.

12. The apparatus of claim 11, wherein the registration position is at a side wall of the paper accumulator.

13. The apparatus of claim 11, wherein the at least one first roller includes two or more first rollers that contact the first edge of the sheet of paper without contacting a face of the sheet of paper.

14. The apparatus of claim 11, wherein the transmission includes a worm gear, a crown gear and a belt.

15. The apparatus of claim 14, wherein the belt is a timing belt.

16. Apparatus for handling a sheet of material, comprising:

means for applying a force against a first edge of the sheet in a first direction parallel to the first edge, so as to move the sheet within the paper accumulator at least until a second edge of the sheet reaches a registration position;

means for moving the sheet of paper to cause the edge of the sheet to contact the force applying means; and means for stopping the force applying means when the second edge of the sheet reaches the registration position.

wherein before the force applying means applies the force against the first edge of the sheet, the moving means moves the sheet in a second direction perpendicular to the first direction, allows the sheet to move in a third direction opposite the second direction, and orients the sheet so that the weight of the sheet applies a force orthogonal to the force of the force applying means.

17. A method for handling a sheet of material, comprising the steps of:

(a) rotating a feed roller to advance the sheet vertically until a bottom edge of the sheet reaches the feed roller;

(b) rolling the bottom edge of the sheet over a top of the feed roller;

(c) dropping the sheet of material vertically, so the bottom edge contacts a horizontal force applying means; and (d) applying a friction force against the bottom edge of the sheet in a horizontal direction parallel to the bottom edge with the horizontal force applying means, so as to move the sheet at least until a second edge of the sheet reaches a registration position.

18. The method of claim 17, wherein step (b) includes changing a direction of movement of the sheet from upwards to downwards.

19. A method for handling a sheet of material, comprising:

orienting the sheet for contact of a first edge of the sheet with at least one roller, including advancing the sheet in a first direction and allowing the sheet to drop in a second direction opposite the first direction, wherein the weight of the sheet applies a normal force against the at least one roller;

rotating the at least one roller and moving the sheet in a third direction orthogonal to the first direction at least until a second edge of the sheet reaches a registration position; and stopping the rotating of the at least one roller when the sheet reaches the registration position.

20. The method of claim 19, wherein the first direction is a first vertical direction, the second direction is a second vertical direction opposite the first vertical direction, and the third direction is a horizontal direction.

* * * * *

UNITED STATES PATENT AND TRADEMARK OFFICE

CERTIFICATE OF CORRECTION

PATENT NO. : 7,104,540 B2
APPLICATION NO. : 10/228713
DATED : September 12, 2006
INVENTOR(S) : Israel Cruz Ruiz It is certified that error appears in the above-identified patent and that said Letters Patent is hereby corrected as shown below:

In column 3, line 20, delete “wail” and insert -- wall --, therefor.

In column 5, line 35, in Claim 1, delete “the steps of”.

In column 5, line 45, in Claim 1, delete “section” and insert -- second --, therefor.

In column 5, line 53, in Claim 2, after “sheet” insert -- includes contacting the first edge of the sheet --.

In column 6, line 9, in Claim 6, after “first direction” insert -- , including moving the sheet in the second direction and allowing the sheet to drop in a third direction opposite the second direction so as to orient the sheet of material vertically above the one or more first rollers, so that the weight of the material applies a normal force against the one or more first rollers --.

In column 6, line 13, in Claim 7, insert -- at least one -- before “second roller”.

In column 6, line 14, in Claim 7, insert -- one or more -- before “first rollers”.

In column 6, line 20, in Claim 8, after “paper;” insert -- and --.

In column 6, line 21, in Claim 8, after “rotating the” insert -- one or more --.

In column 6, line 21, in Claim 8, after “with the” delete “same”.

In column 7, line 11, in Claim 16, after “sheet” delete “within the paper accumulator”.

In column 7, line 14, in Claim 16, after “cause the” insert -- first --.

UNITED STATES PATENT AND TRADEMARK OFFICE

CERTIFICATE OF CORRECTION

PATENT NO. : 7,104,540 B2
APPLICATION NO. : 10/228713
DATED : September 12, 2006
INVENTOR(S) : Israel Cruz Ruiz It is certified that error appears in the above-identified patent and that said Letters Patent is hereby corrected as shown below:

In column 7, lines 17-18, in Claim 16, after "position" delete "." and insert -- , --, therefor.

Signed and Sealed this

Seventeenth Day of February, 2009

John Doll

JOHN DOLL
*Acting Director of the United States Patent and Trademark Office*